US005622508A

United States Patent [19]

Nagahata et al.

[11] Patent Number: 5,622,508

[45] Date of Patent: Apr. 22, 1997

[54] ELECTRICAL CONNECTOR AND THERMAL PRINTHEAD USING THE SAME

[75] Inventors: Takaya Nagahata; Tokihiko Kishimoto, both of Ukyo-ku, Japan

[73] Assignee: Rohm Co., Ltd., Kyoto, Japan

[21] Appl. No.: 200,484

[22] Filed: Feb. 23, 1994

[30] Foreign Application Priority Data

Feb. 24, 1993 [JP] Japan ..... 5-035457

[51] Int. Cl.[6] ..... H01R 9/09

[52] U.S. Cl. ..... 439/79; 439/885

[58] Field of Search ..... 439/59, 62, 79, 439/80, 856, 857, 861, 862, 630–636, 885, 858

[56] References Cited

U.S. PATENT DOCUMENTS

| | | | |
|---|---|---|---|
| 3,902,776 | 9/1975 | Williams et al. | 439/885 |
| 4,019,803 | 4/1977 | Schell | 439/876 |
| 4,226,499 | 10/1980 | Bauerle | 439/858 |
| 4,302,067 | 11/1981 | Monson et al. | 439/876 |
| 4,556,276 | 12/1985 | Curtis, III | 439/862 |
| 4,586,254 | 5/1986 | Ammon et al. | 439/59 |
| 4,978,307 | 12/1990 | Billman et al. | 439/885 |
| 4,992,052 | 2/1991 | Verhoeven | 439/62 |
| 4,993,956 | 2/1991 | Pickles et al. | 439/76 |
| 5,207,598 | 5/1993 | Yamada et al. | 439/636 |

FOREIGN PATENT DOCUMENTS

| | | |
|---|---|---|
| 2348482 | 4/1975 | Germany . |
| 2435399 | 2/1976 | Germany . |
| 2441209 | 3/1976 | Germany . |
| 3235717 | 3/1984 | Germany . |
| 4028105 | 12/1991 | Germany . |
| 2-95642 | 7/1990 | Japan . |
| 2-95643 | 7/1990 | Japan . |

*Primary Examiner*—Hien D. Vu
*Attorney, Agent, or Firm*—William H. Eilberg

[57] ABSTRACT

An electrical connector for a circuit board is provided which comprises a connector housing having a pin retaining wall which is provided with a plurality of insertion holes, and a plurality of terminal pins each having a stem portion for insertion into a corresponding one of the insertion holes. Each of the terminal pins includes a clip portion arranged outside the connector housing. The clip portion includes an opposed pair of legs extending from a connecting web away from the pin retaining wall of the connector housing. The opposed pair of legs approach each other in a direction away from the connecting web but being elastically openable for engagement with the circuit board.

18 Claims, 4 Drawing Sheets

ELECTRICAL CONNECTOR AND THERMAL PRINTHEAD USING THE SAME

BACKGROUND OF THE INVENTION

1. Field of the Invention

This invention relates to an electrical connector which may be used for electrically connecting a circuit board to an external circuit. The present invention also relates to a thermal printhead which incorporates such an electrical connector.

2. Description of the Prior Art

As is well known, there are various arrangements for electrically connecting a circuit board to an external circuit. For example, in a thermal printhead including a head circuit board which need be electrically connected to an external circuit, a plurality of terminal pins each having a clip end are brought into electrical contact with connection terminals formed on the circuit board, whereby the connection terminals are electrically connected to the external circuit via the terminal pins. Due to insufficiency of the clipping force exerted by the clip end, the respective terminal pins need be fixed in position by soldering or by depositing a layer of resin, as disclosed in Japanese Utility Model Application Laid-open No. 2-95642 or 2-95643.

However, the use of separate terminal pins requires separate positional adjustment of the pins relative to the connection terminals of the head circuit board, thereby prolonging the time required for electrical connection. Further, the soldering or resin-depositing operation requires an additional apparatus designed for that purpose, consequently resulting in a production cost increase. Moreover, the soldering operation inevitably involves the risks of shorting between the connection terminals of the head circuit board and of thermally damaging related heat-sensitive components.

Either of the above laid-open Japanese utility model applications also discloses an electrical connector which comprises a connector housing and a plurality of terminal pins projecting from the housing for press-fit insertion into respective connection holes of a head circuit board from below. However, since the connector housing is located below the circuit board under the influences of gravity and the press-fit is the sole means for connection, the electrical connector may be unexpectedly removed from the circuit board due to vibrations during the operation of the thermal printhead.

SUMMARY OF THE INVENTION

It is, therefore, an object of the present invention to provide an electrical connector which, while incorporating a plurality of terminal pins, can be conveniently and stably mounted to a circuit board.

The present invention also provides a thermal printhead which utilizes such an electrical connector.

According to one aspect of the present invention, there is provided an electrical connector for a circuit board comprising: a connector housing having a pin retaining wall which is provided with a plurality of insertion holes; and a plurality of terminal pins each having a stem portion for insertion into a corresponding one of the insertion holes; wherein each of the terminal pins includes a clip portion arranged outside the connector housing; and wherein the clip portion includes an opposed pair of legs extending from a connecting web away from the pin retaining wall of the connector housing, the opposed pair of legs approaching each other in a direction away from the connecting web but being elastically openable for engagement with the circuit board.

According to a preferred embodiment of the present invention, the stem portion has a pusher end projecting beyond the entirety of the clip portion. Further, the stem portion is contained in a first plane, whereas the clip portion is contained in a second plane which is offset from the first plane transversely of the stem portion. In this case, the pin retaining wall of the connector housing may provided with projections arranged alternately with the respective insertion holes, so that the connecting web of the clip portion comes into abutment with a corresponding one of the projections when the stem portion is inserted into the corresponding one of the insertion holes.

Preferably, the stem portion has a tapered end for facilitating insertion thereof into the corresponding one of the insertion holes. It is further preferable if each of the respective legs of the clip portion is made to have a rounded contact portion for contact with the circuit board.

According to another aspect of the present invention, there is provided a thermal printhead comprising a head circuit board and at least one electrical connector mounted to the circuit board, the circuit board having a thermal printing element and drive ICs for actuating the printing element, the circuit board further having at least one group of connection terminals for connection to an external circuit through the electrical connector, the electrical connector comprising a connector housing having a pin retaining wall which is provided with a plurality of insertion holes, and a plurality of terminal pins each having a stem portion for insertion into a corresponding one of the insertion holes, wherein each of the terminal pins includes a clip portion arranged outside the connector housing; and wherein the clip portion includes an opposed pair of legs extending from a connecting web away from the pin retaining wall of the connector housing, the opposed pair of legs being elastically openable for engagement with the circuit board.

Other objects, features and advantages of the present invention will be fully understood from the following detailed description given with reference to the accompanying drawings.

DETAILED DESCRIPTION OF THE PREFERRED EMBODIMENT

Figure 1:
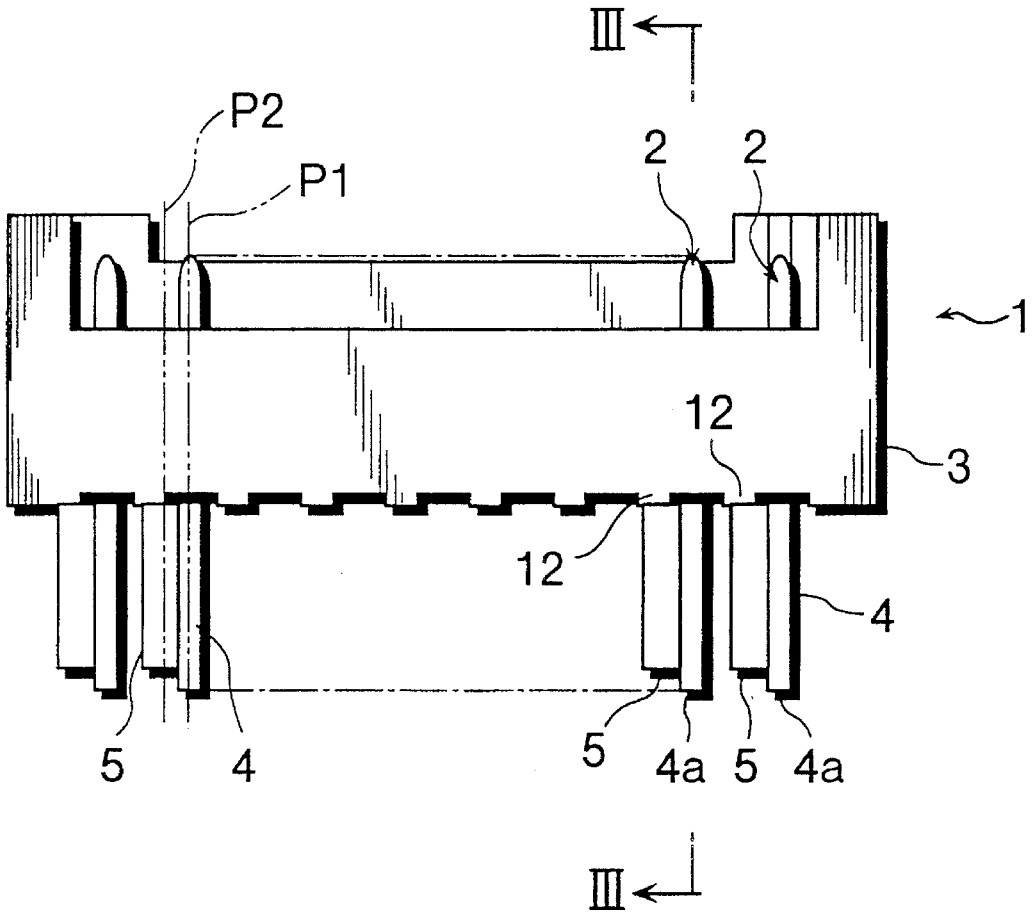
FIG. 1 is a plan view showing an electrical connector according to an embodiment of the present invention.
Figure 2:
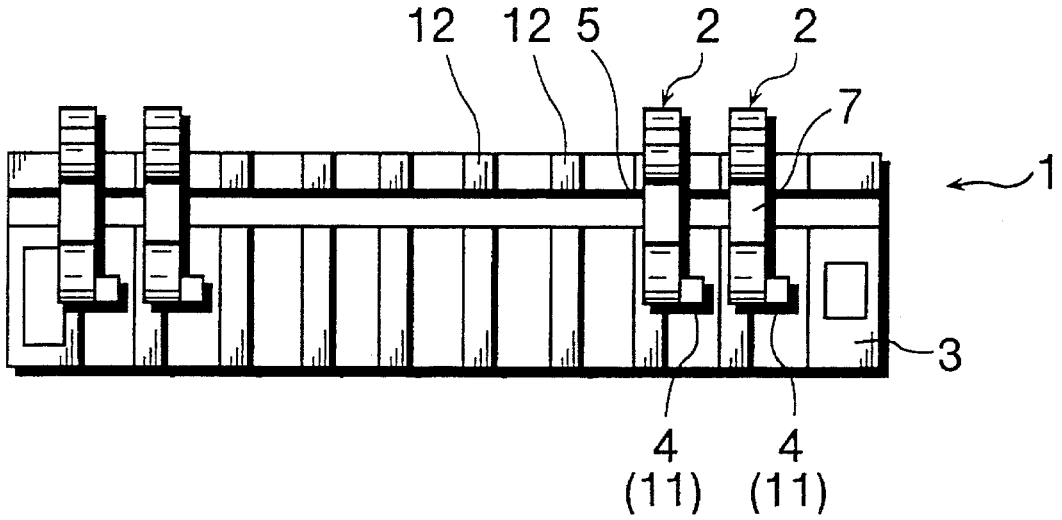
FIG. 2 is a front view showing the same connector.

Referring first to FIGS. 1 and 2 of the accompanying drawings, there is illustrated a socket-type electrical connector 1 according to an embodiment of the present invention. The electrical connector 1 mainly comprises a connector housing 3 made of an insulating material such as resin, and a plurality of terminal pins 2 held by the housing 3.

Figure 3:
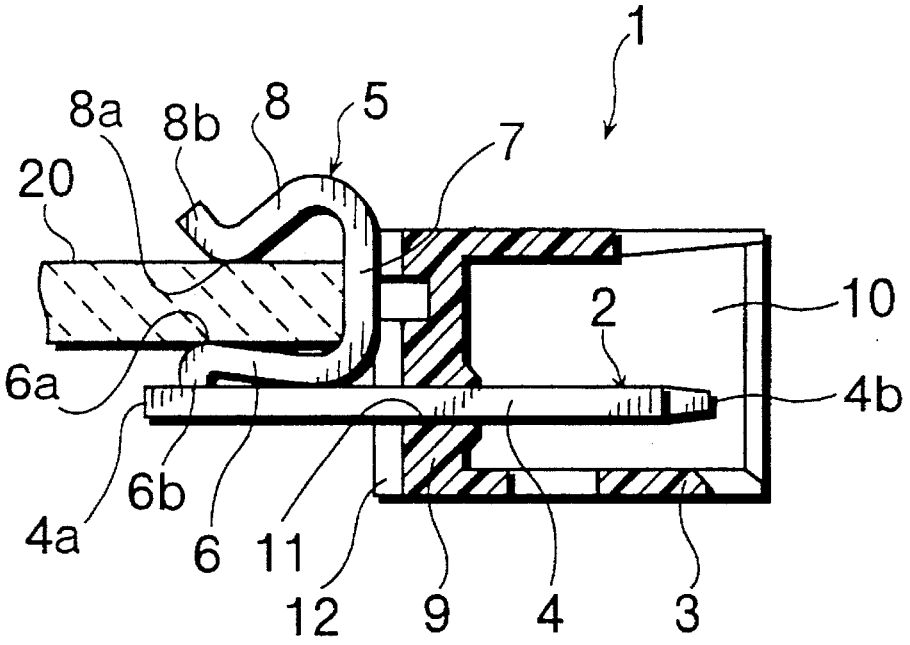
FIG. 3 is a sectional view showing taken along lines III—III in FIG. 1.
Figure 4:
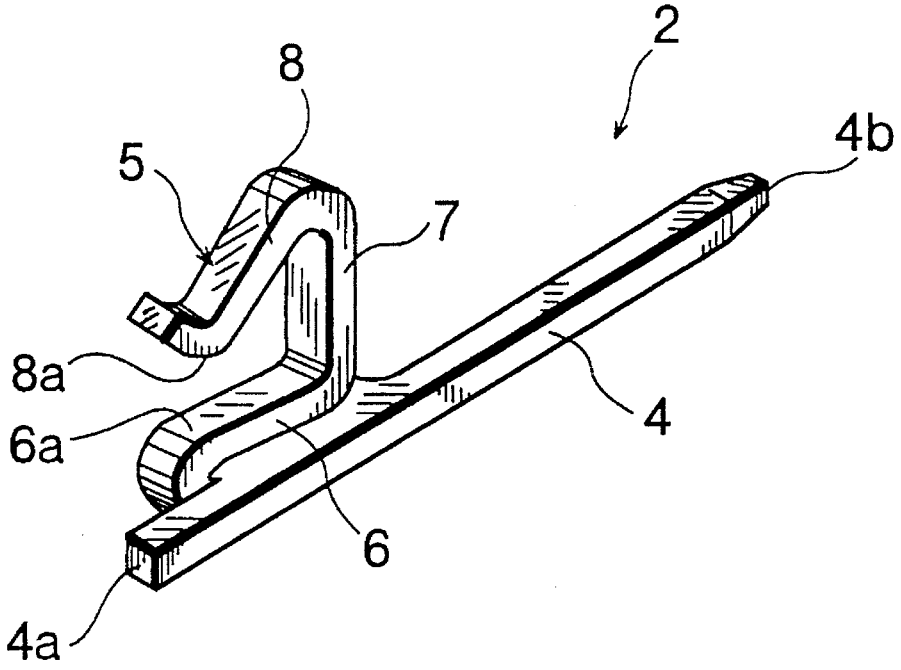
FIG. 4 is a perspective view showing a terminal pin incorporated in the connector of FIG. 1.

As better shown in FIGS. 3 and 4, each of the terminal pins 2 includes a stem portion 4 and a clip portion 5. The stem portion 4 has a pusher end 4*a* and a tapered end 4*b*. The clip portion 5 has a first leg 6 integral with the stem portion 4, a connecting web 7 integrally extending from the first leg 6 substantially perpendicularly to the stem portion 4, and a second leg 8 integrally extending from the connecting web 7 in opposed relation to the first leg 6. The distance between the first and second legs 6, 8 is made to reduce toward the pusher end 4*a* of the stem portion 4. The first and second legs 6, 8 have respective contact portions 6*a*, 8*a* which are rounded for smoothly fitting to a circuit board 20 (FIG. 3). Further, the first and second legs 6, 8 have respective mouth ends 6*b*, 8*b* which are bent away from each other for conveniently fitting onto the circuit board 20.

According to the illustrated embodiment, a plane P1 (see FIG. 1) containing the pin stem portion 4 is offset from another plane P2 containing the pin clip portion 5 transversely of the stem portion 4. Further, the pusher end 4*a* of the stem portion 4 projects beyond the entirety of the clip portion 5, as shown in FIGS. 1, 3 and 4.

The connector housing 3, which is in the form of a socket or shroud, has a pin retaining wall 9 at one longitudinal side and a socket opening 10 at the opposite longitudinal side. The pin retaining wall 9 is formed with a longitudinal row of insertion holes 11 in which the stem portions 4 of the respective pins 2 are press-fitted from the side away from socket opening 10. The pin retaining wall 9 is also formed with a plurality of elongate backup projections 12 arranged alternately with the insertion holes 11, as shown in FIG. 2. Each of the elongate backup projections 12 extends transversely to the longitudinal direction of the pin retaining wall 9.

When each of the terminal pins 2 is fitted to the connector housing 3, the tapered end 4*b* of the stem portion 4 is introduced in a corresponding one of the insertion holes 11. In this condition, the pusher end 4*a* of the stem portion 4 is pushed by a pushing tool (not shown) until the connecting web 7 of the clip portion 5 comes into intimate abutment with a corresponding one of the elongate backup projections 12, as shown in FIG. 3.

Figure 5:
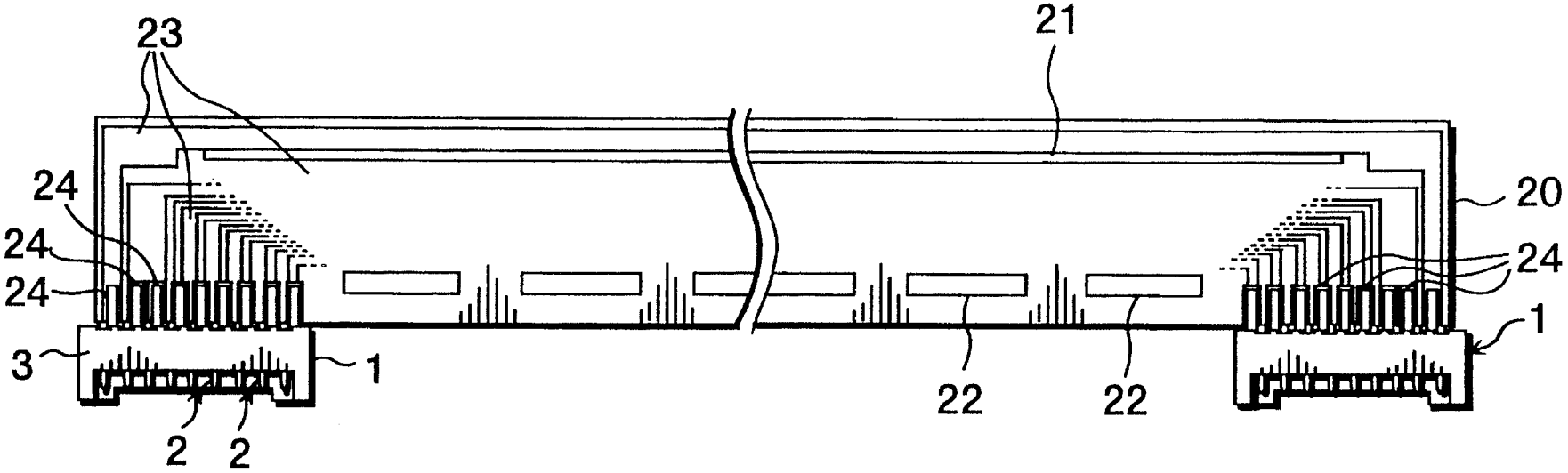
FIG. 5 is a plan view showing an example of thermal head which incorporates the connector of FIG. 1.
Figure 6:
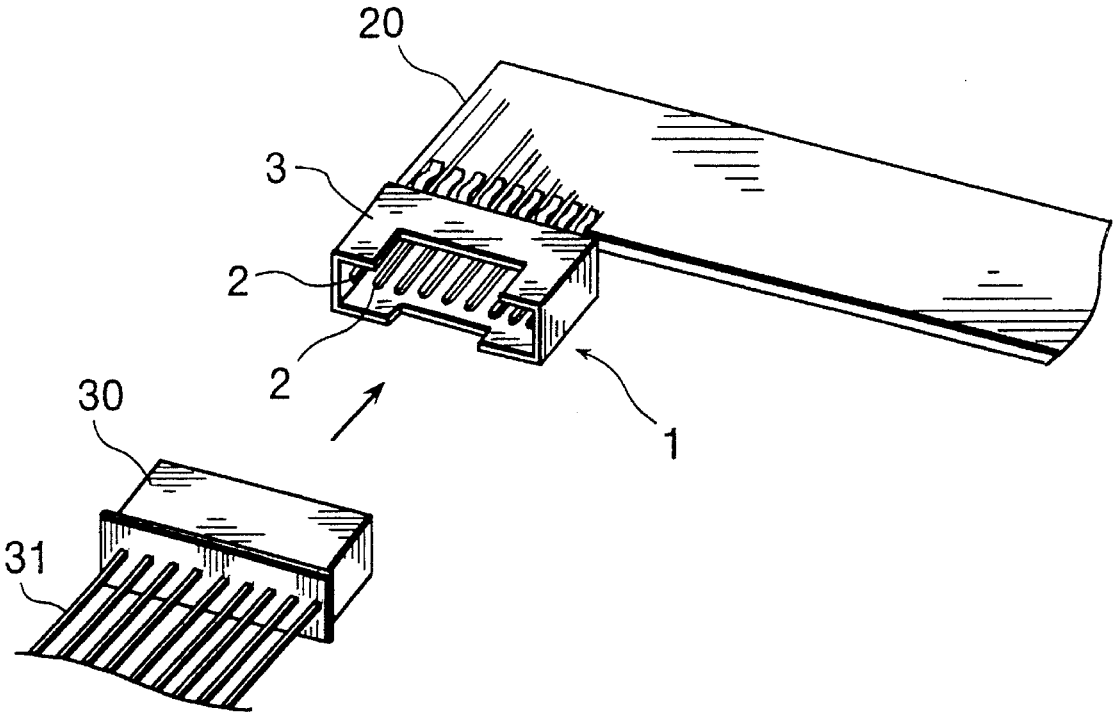
FIG. 6 is a perspective view showing the same thermal head.

As shown in FIGS. 5 and 6, the circuit board 20 may be a strip-like head circuit board for a thermal printhead. The illustrated head circuit board 20 carries a linear heating resistor 21 extending along a first longitudinal edge of the circuit board 20 adjacent thereto, and an array of drive ICs 22 extending along a second longitudinal edge which is opposite to the first longitudinal edge. The circuit board 20 further carries a conductor circuit pattern 23 for establishing electrical connection between the various circuit elements.

The conductor circuit pattern 23 is associated with two groups of connection terminals 24 arranged at the second longitudinal edge of the circuit board 20 on respective sides of the array of drive ICs 22. Obviously, each group of connection terminals 24 is used for electrical connection to an external circuit through an electrical connector 1 which has the above-described arrangement. In the illustrated embodiment, the socket-type electrical connector 1 is fitted to a complementary plug-type connector 30 having a set of cables 31, as shown in FIG. 6.

Though not illustrated, the head circuit board 20 may be supported on a metal support plate which works also as a heat sink. Further, the head circuit board (or the thermal printhead incorporating it) may further comprise other elements such as a protective resin body for enclosing the array of drive ICs 22.

The socket-type electrical connector 1 is mounted to the head circuit board 20 at a corresponding group of connection terminals 24 in the following manner. First, the connector housing 3 is held manually or mechanically and adjusted positionally relative to the circuit board 20 to bring the respective clip portions 5 of the terminal pins 2 (FIGS. 1 and 2) into alignment with the respective connection terminals 24 (FIG. 5) of the circuit board 20. Then (finally), the connector housing 3 is advanced so that the circuit board 20 enters between the respective legs 6, 8 of each pin clip portion 5 which are elastically opened. As a result, the contact portion 6a of the first leg 6 elastically engages the underside of the circuit board 20, whereas the contact portion 8*a* of the second leg 8 is brought into elastic electrical contact with a corresponding one of the connection terminals 24 (see FIG. 6).

According to the arrangement of the illustrated embodiment, the following advantages are obtainable.

(1) Since all of the terminal pins 2 are positionally adjusted relative to and mounted to the circuit board 20 as a single unit integrated by the connector housing 3, it is possible to reduce the time required for mounting the terminal pins 2.

(2) Since the respective legs 6, 8 of each terminal pin 2 (namely, each clip portion 5) extend from the connecting web 7 away from the pin retaining wall 9 of the connector housing 3, the electrical connector 1 can be conveniently mounted by moving the connector housing 3 sidewise relative to the circuit board 20. Further, such sidewise or lateral mounting is also preferable in that the thickness of the connector housing 3 is not additional to the thickness of the circuit board 20, thereby reducing the overall thickness of the thermal head in comparison with the prior art wherein an electrical connector is mounted to the underside of a head circuit board.

(3) Since the clip portions 5 of all the terminal pins 2 exert respective elastic clipping forces relative to the circuit board 20, the sum of these forces is sufficient for firmly holding the electrical connector 1 as a whole.

(4) Since the connecting web 7 of each clip portion 5 is held in abutment with or backed up by a corresponding one of the elongate backup projections 12, a pushing force applied to the connector housing 3 can be directly transmitted to the clip portion 5 for facilitating sidewise mounting of the electrical connector 1 relative to the head circuit board 20. Further, the abutment between the clip portion 5 and the corresponding projection 12 is also advantageous in that such abutment always ensures a suitable degree to which the stem portion 4 is inserted in a corresponding one of the insertion holes 11.

(5) Since the pusher end 4*a* of each stem portion 4 projects beyond the entirety of the clip portion 5, an inserting push applied to the stem portion 4 does not cause unwanted deformation of the clip portion 5 at the time of inserting the stem portion 4 in the corresponding insertion hole 11. Such an advantage is particularly pronounced when the plane P1 containing the stem portion 4 is transversely offset from the plane P2 containing the clip portion 5. By contrast, if the clip portion 5 is formed as an extension of the stem portion 4, an inserting push is inevitably applied to the clip portion to result in unwanted deformation of the clip portion.

The present invention being thus described, it is obvious that the same may be varied in many ways. For instance, the thermal printhead may be made to incorporate only one electrical connector. Further, the electrical connector 1, which is of the socket type according to the illustrated embodiment, may be of the plug type. Such variations are not to be regarded as a departure from the spirit and scope of the invention, and all such variations as would be obvious to those skilled in the art are intended to be included within the scope of the following claims.

We claim:

1. An electrical connector for a circuit board comprising:

a single connector housing having a pin retaining wall which is provided with a plurality of insertion holes and having a shroud extending from said pin retaining wall for receiving a mating connector;

a plurality of terminal pins each having a stem portion for insertion into the single connector housing through a corresponding one of the insertion holes;

wherein each of the terminal pins includes a clip portion arranged outside the single connector housing; and wherein the clip portion includes an opposed pair of legs extending from a connecting web away from the pin retaining wall of the single connector housing, the opposed pair of legs approaching each other in a direction away from the connecting web but being elastically openable for engagement with the circuit board.

2. The electrical connector according to claim 1, wherein the stem portion has a pusher end projecting beyond the entirety of the clip portion.

3. The electrical connector according to claim 2, wherein the stem portion is contained in a first plane, the clip portion being contained in a second plane which is offset from the first plane transversely of the stem portion.

4. The electrical connector according to claim 3, wherein the pin retaining wall of the single connector housing is provided with projections arranged alternately with the respective insertion holes, the connecting web of the clip portion coming into abutment with a corresponding one of the projections when the stem portion is inserted into the corresponding one of the insertion holes.

5. The electrical connector according to claim 1, wherein the stem portion has a tapered end for facilitating insertion thereof into the corresponding one of the insertion holes.

6. The electrical connector according to claim 1, wherein each of the respective legs of the clip portion has a rounded contact portion for contact with the circuit board.

7. The electrical connector according to claim 1, wherein the connecting web of the clip portion is substantially straight and extends in parallel to the pin retaining wall of the single connector housing.

8. The electrical connector according to claim 1, wherein the connecting web of the clip portion directly contacts the pin retaining wall of the single connector housing.

9. The electrical connector according to claim 1, wherein the single connector housing has a socket opening, a part of the clip portion extending beyond the socket opening of the single connector housing in one direction parallel to the pin retaining wall of the single connector housing.

10. A thermal printhead comprising a head circuit board and at least one electrical connector mounted to the circuit board, the circuit board having a thermal printing element and drive ICs for actuating the thermal printing element, the circuit board further having at least one group of connection terminals for connection to an external circuit through the electrical connector, the electrical connector comprising a single connector housing having a pin retaining wall which is provided with a plurality of insertion holes and having a shroud extending from said pin retaining wall for receiving a mating connector, and a plurality of terminal pins each having a stem portion for insertion into the single connector housing through a corresponding one of the insertion holes, wherein each of the terminal pins includes a clip portion arranged outside the single connector housing; and wherein the clip portion includes an opposed pair of legs extending from a connecting web away from the pin retaining wall of the single connector housing, the opposed pair of legs approaching each other in a direction away from the connecting web, the opposed pair of legs being elastically openable for engagement with the circuit board.

11. The thermal printhead according to claim 10, wherein the stem portion has a pusher end projecting beyond the entirety of the clip portion.

12. The thermal printhead according to claim 11, wherein the stem portion is contained in a first plane, the clip portion being contained in a second plane which is offset from the first plane transversely of the stem portion.

13. The thermal printhead according to claim 12, wherein the pin retaining wall of the single connector housing is provided with projections arranged alternately with the respective insertion holes, the connecting web of the clip portion coming into abutment with a corresponding one of the projections when the stem portion is inserted into the corresponding one of the insertion holes.

14. The thermal printhead according to claim 10, wherein the stem portion has a tapered end for facilitating insertion thereof into the corresponding one of the insertion holes.

15. The thermal printhead according to claim 10, wherein each of the respective legs of the clip portion has a rounded contact portion for contact with the circuit board.

16. The thermal printhead according to claim 10, wherein the connecting web of the clip portion is substantially straight and extends in parallel to the pin retaining wall of the single connector housing.

17. The thermal printhead connector according to claim 10, wherein the connecting web of the clip portion directly contacts the pin retaining wall of the single connector housing.

18. The thermal printhead according to claim 10, wherein the single connector housing has a socket opening, a part of the clip portion extending beyond the socket opening of the single connector housing in one direction parallel to the pin retaining wall of the single connector housing.

* * * * *